US007773902B2

(12) United States Patent
Takayanagi

(10) Patent No.: US 7,773,902 B2
(45) Date of Patent: Aug. 10, 2010

(54) IMAGE FORMING APPARATUS WITH VOLTAGE CONTROL

(75) Inventor: Hiroki Takayanagi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 235 days.

(21) Appl. No.: 11/936,435

(22) Filed: Nov. 7, 2007

(65) Prior Publication Data

US 2008/0267648 A1 Oct. 30, 2008

(30) Foreign Application Priority Data

Nov. 22, 2006 (JP) ..... 2006-316370

(51) Int. Cl.
*G03G 15/16* (2006.01)

(52) U.S. Cl. ..... 399/66; 399/49

(58) Field of Classification Search ..... 399/66, 399/302, 308, 49, 297, 101
See application file for complete search history.

(56) References Cited

U.S. PATENT DOCUMENTS

| | | | | |
|---|---|---|---|---|
| 6,427,062 | B1 | 7/2002 | Takeuchi | |
| 6,842,600 | B2 | 1/2005 | Takayanagi | |
| 7,315,702 | B2 | 1/2008 | Takayanagi | |
| 2001/0051056 | A1* | 12/2001 | Noguchi et al. | 399/66 |
| 2003/0219286 | A1* | 11/2003 | Soda et al. | 399/297 |
| 2006/0171735 | A1* | 8/2006 | Hamada et al. | 399/101 |
| 2007/0047986 | A1* | 3/2007 | Fujimori et al. | 399/49 |
| 2007/0059027 | A1* | 3/2007 | Ishikawa et al. | 399/101 |

FOREIGN PATENT DOCUMENTS

| | | | |
|---|---|---|---|
| JP | 3-238484 | A | 10/1991 |
| JP | 10-288879 | A | 10/1998 |
| JP | 2001-215859 | A | 8/2001 |
| JP | 2005-308931 | A | 4/2005 |
| JP | 2006-98473 | A | 4/2006 |

* cited by examiner

*Primary Examiner*—Quana M Grainger
(74) *Attorney, Agent, or Firm*—Fitzpatrick, Cella, Harper & Scinto

(57) ABSTRACT

An image forming apparatus has: an intermediate transfer member to which a primary transfer voltage having a positive polarity is applied and the toner image is primarily transferred in which a reverse voltage having a negative polarity is applied; a primary transfer device which primarily transfers the toner image by applying the primary transfer voltage; a secondary transfer device which secondarily transfers the toner image by applying a secondary transfer voltage; and a resistance adjusting device which controls at least either the primary transfer device or the secondary transfer device in such a manner that while the intermediate transfer member rotates once, a first correction voltage is applied to the area where the primary transfer voltage has been applied and a second correction voltage higher than the first voltage is applied to the area where the reverse voltage has been applied.

8 Claims, 9 Drawing Sheets

IMAGE FORMING APPARATUS WITH VOLTAGE CONTROL

BACKGROUND OF THE INVENTION

1. Field of the Invention

The present invention relates to an image forming apparatus for primarily transferring a toner image formed on an image bearing member onto an intermediate transfer member and, thereafter, secondarily transferring the toner image onto a recording material. More particularly, the invention relates to control for reducing an influence of a resistance change of an intermediate transfer member on an image that is caused when a reverse bias voltage adapted to prevent a detection toner image, such as a color patch or the like, from being transferred onto the intermediate transfer member has been applied.

2. Description of the Related Art

There has been put into practical use an image forming apparatus constructed in such a manner that toner images of separation colors are sequentially primarily transferred and overlaid onto an intermediate transfer member and the overlaid toner images are secondarily transferred from the intermediate transfer member onto a recording material together, thereby forming a full-color image.

In Japanese Patent Application Laid-Open No. 2005-308931, there has been disclosed an image forming apparatus which has a developing device of a developing color rotation switching type and which is constructed in such a manner that toner images of separation colors are sequentially formed by one photosensitive drum (image bearing member) and are sequentially overlaid onto an intermediate transfer member. A secondary transferring apparatus for secondarily transferring the toner images from the intermediate transfer member onto the recording material together can come into contact with or can be separated from the intermediate transfer member. An intermediate transfer member cleaning device of an electrostatic fur brush type is arranged on a downstream side of the secondary transferring apparatus.

In Japanese Patent Application Laid-Open No. 2006-98473, there has been disclosed an image forming apparatus constructed in such a manner that a detection toner image (color patch) for concentration detection formed on a photosensitive drum is optically detected on a surface of the photosensitive drum just after a developing device and a result of the concentration detection is fed back to a developing voltage.

According to the image forming apparatus disclosed in Japanese Patent Application Laid-Open No. 2006-098473, it is necessary that the detection toner image is promptly removed from an intermediate transfer member after the concentration detection so as not to be overlaid on a toner image of an actual image. One of the methods of removing the detection toner image is a method whereby the detection toner image is primarily transferred onto the intermediate transfer member and circulated and the detection toner image is removed by an intermediate transfer member cleaning device on the downstream side of a secondary transfer position.

However, there is a case where the detection toner image which has primarily been transferred onto the intermediate transfer member cannot be sufficiently removed by the intermediate transfer member cleaning device. For example, in the case where an electrostatic fur brush is used in the intermediate transfer member cleaning device as disclosed in Japanese Patent Application Laid-Open No. 2005-808931 or an intermediate transfer belt is used as an intermediate transfer member, it is difficult to sufficiently remove the detection toner image.

Therefore, there has been proposed such a technique that the detection toner image is allowed to pass through a primary transfer position without being primarily transferred onto the intermediate transfer member and the detection toner image is removed by a drum cleaning device provided for the photosensitive drum. An electric field in the direction opposite to that upon ordinary primary transfer of the toner image is made to act at the primary transfer position, thereby preventing the detection toner image from being primarily transferred onto the intermediate transfer member.

However, it has been confirmed that if the detection toner image is repetitively formed in a same area in the moving direction of the intermediate transfer member and a voltage of the same polarity as a charging polarity of the toner image is repetitively applied to such an area, a transfer fluctuation occurs between such an area and an area before/after such an area. That is, if the normal toner image is primarily transferred in place of the detection toner image into the area where the detection toner image has repetitively been formed and is secondarily transferred onto the recording material, concentration of the image formed on the recording material becomes uneven and image quality is deteriorated. It has been confirmed that each time the voltage of the same polarity as that of the toner image is applied, a difference between a resistance value in a thickness direction of the intermediate transfer member in such an area where such a voltage has been applied and the resistance value in an area where a normal transfer voltage is applied increases gradually, so that a transfer efficiency difference of the toner image occurs for the same primary transfer voltage.

SUMMARY OF THE INVENTION

It is an object of the invention that even if a voltage of the same polarity as that of a toner image is repetitively applied to an area which is in contact with a detection toner image of an intermediate transfer member, a transfer fluctuation occurring when the image is integratedly formed in a voltage applied area and an area before/after such an area is suppressed.

Another object of the invention is to provide an image forming apparatus comprising: an image bearing member; a toner image forming unit which forms a toner image; an intermediate transfer member to which a primary transfer voltage having a positive polarity is applied and the toner image is primarily transferred while the intermediate transfer member is rotating, wherein a reverse voltage having a negative polarity is applied to a partial area of the intermediate transfer member; a primary transfer unit which primarily transfers the toner image on the image bearing member onto the intermediate transfer member by applying the primary transfer voltage; a secondary transfer unit which secondarily transfers the toner image on the intermediate transfer member onto a recording material by applying a secondary transfer voltage onto the intermediate transfer member; and a resistance adjusting unit which controls at least either the primary transfer unit or the secondary transfer unit in such a manner that while the intermediate transfer member rotates once, a first correction voltage is applied to the area where the primary transfer voltage has been applied and a second correction voltage higher than the first voltage is applied to the area where the reverse voltage has been applied.

Further features of the present invention will become apparent from the following description of exemplary embodiments with reference to the attached drawings.

DESCRIPTION OF THE EMBODIMENTS

An image forming apparatus according to an embodiment of the invention will be described in detail hereinbelow with reference to the drawings. The image forming apparatus of the embodiment is not limited to the embodiment, which will be described hereinbelow. The invention can be also realized by another embodiment in which a part or all of the construction of each embodiment is replaced by an alternative construction so long as a resistance changes as a result that a voltage of a specific polarity has been applied to a partial area (interval) of an intermediate transfer member and such a resistance change is corrected.

In the embodiment, a full-color image forming apparatus for forming toner images of a plurality of separation colors using one photosensitive drum will be described. However, the image forming apparatus of the invention can be also embodied by an image forming apparatus of a tandem type in which a plurality of photosensitive drums are arranged along an intermediate transfer belt, and a monochromatic image forming apparatus using the intermediate transfer belt.

Although only the main portion of the image forming apparatus will be described in the embodiment, the image forming apparatus can be constructed in correspondence to various applications such as printers, various printing apparatuses, copying apparatuses, facsimile apparatuses, and multifunction printers.

With respect to the image forming apparatuses described in the related art and shown in Japanese Patent Application Laid-Open No. 2005-808931 and Japanese Patent Application Laid-Open No. 2006-098473, installed power sources, detailed structures of apparatuses and equipment, and control, their illustration and detailed description are omitted.

<Image Forming Apparatus>

Figure 1:
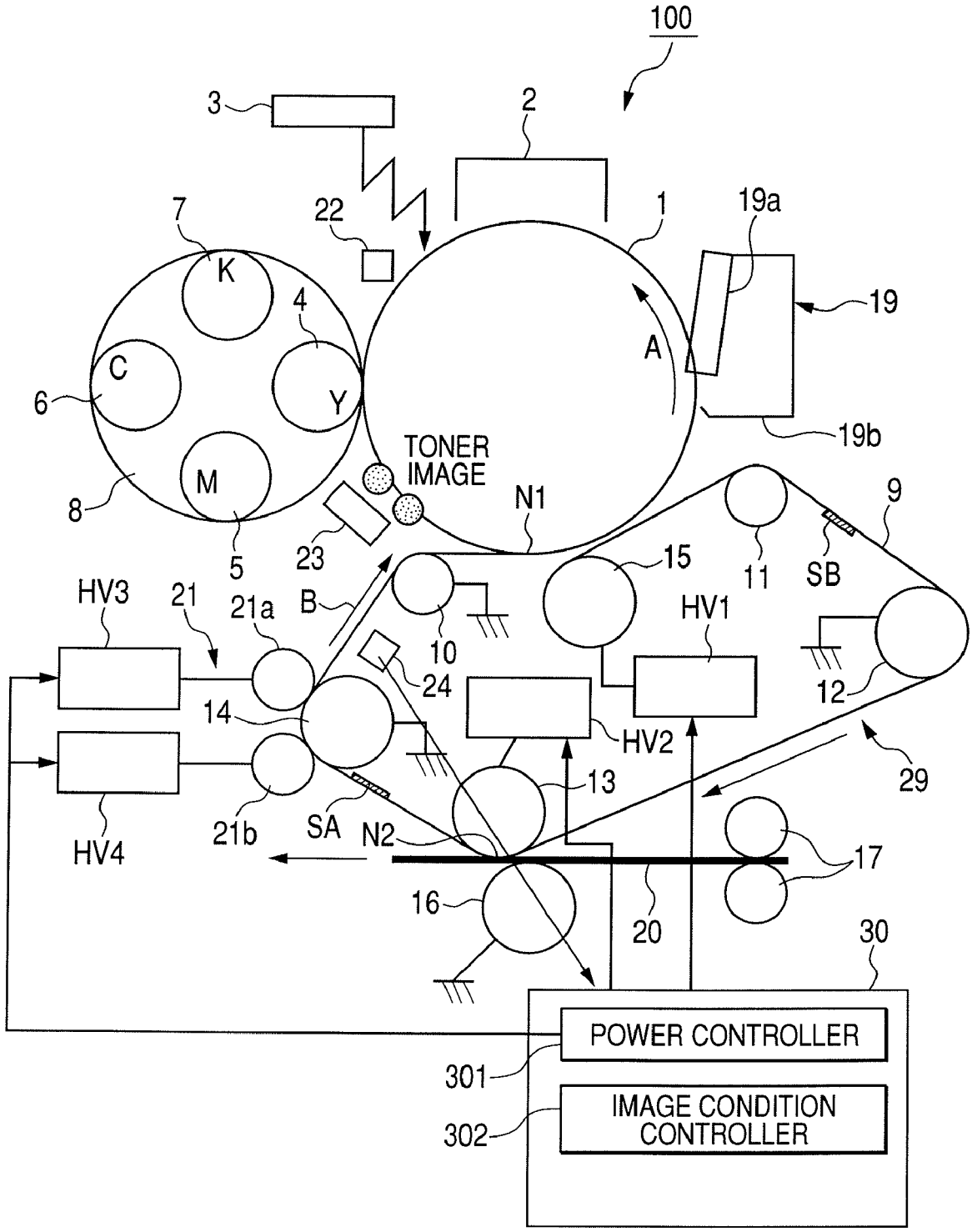
FIG. 1 is a diagram for describing a construction of a main portion of a full-color image forming apparatus of an embodiment.
Figure 2:
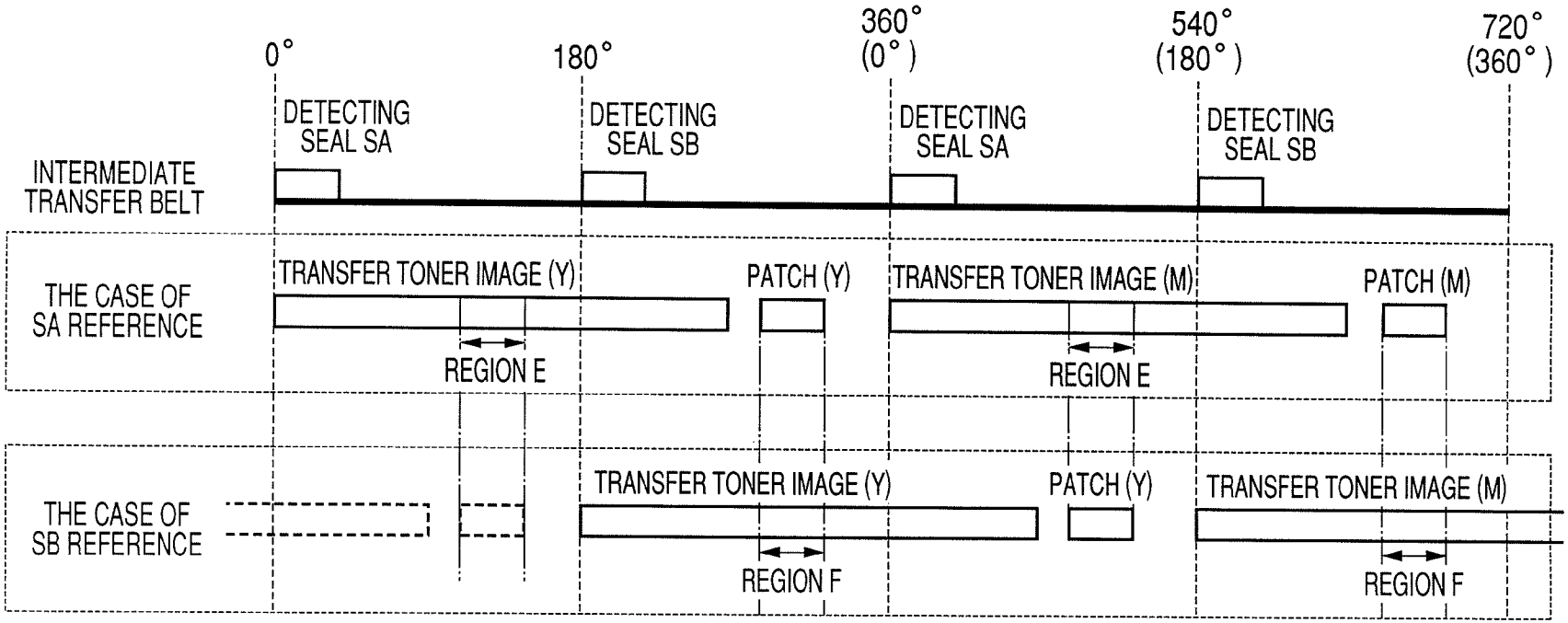
FIG. 2 is a diagram for describing a positional relation between a transfer toner image on an intermediate transfer belt and a patch toner image for concentration detection.
Figure 3:
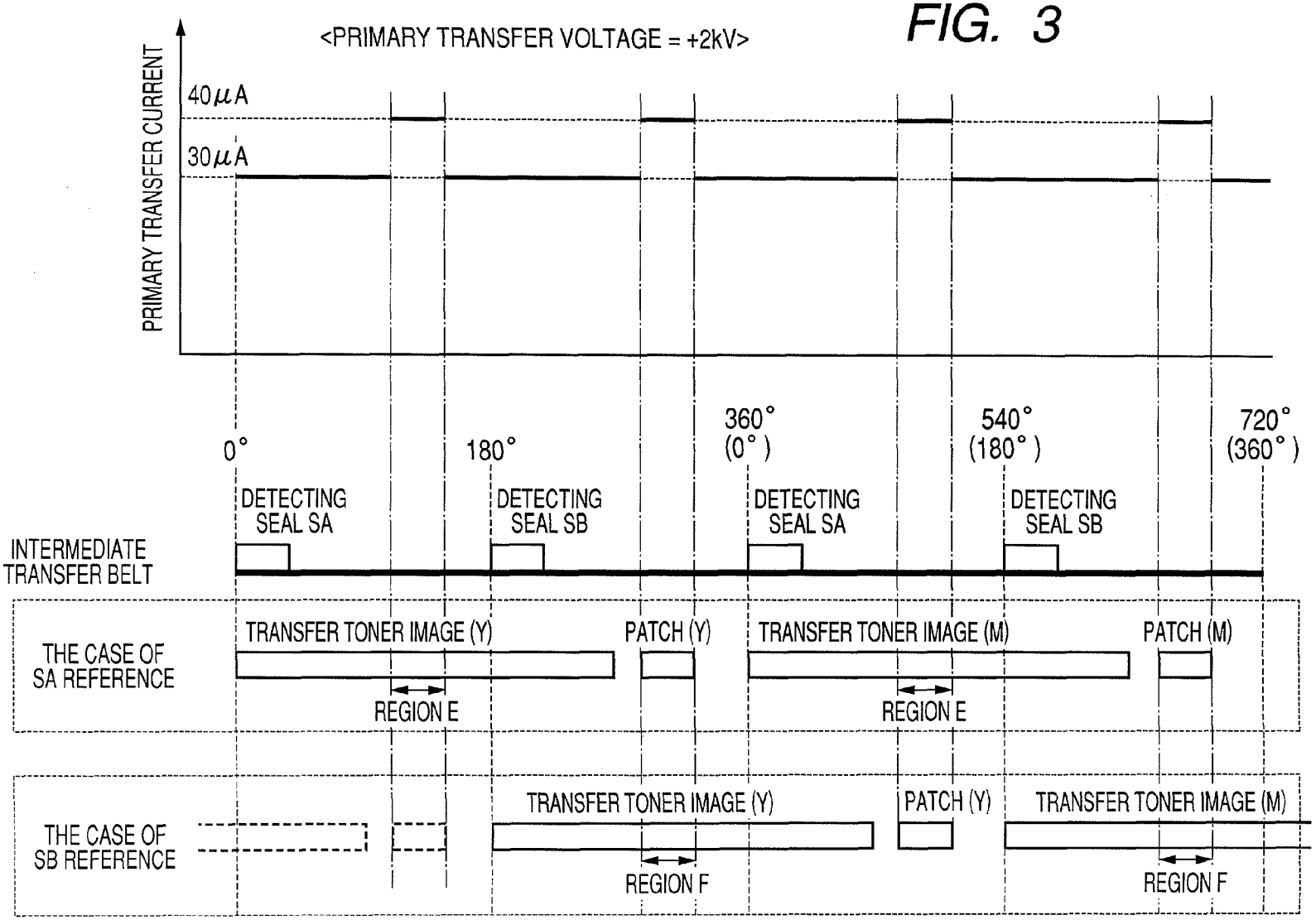
FIG. 3 is a diagram for describing primary transfer currents in the transfer toner image and the patch toner image for concentration detection.
Figure 4:
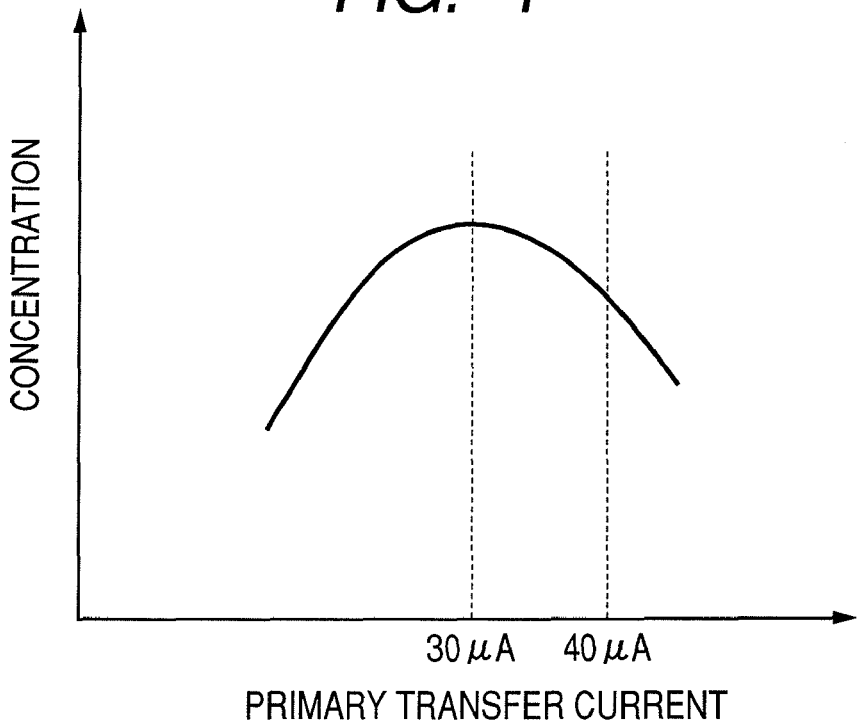
FIG. 4 is a diagram for describing a relation between the primary transfer current and transfer efficiency.
Figure 5:
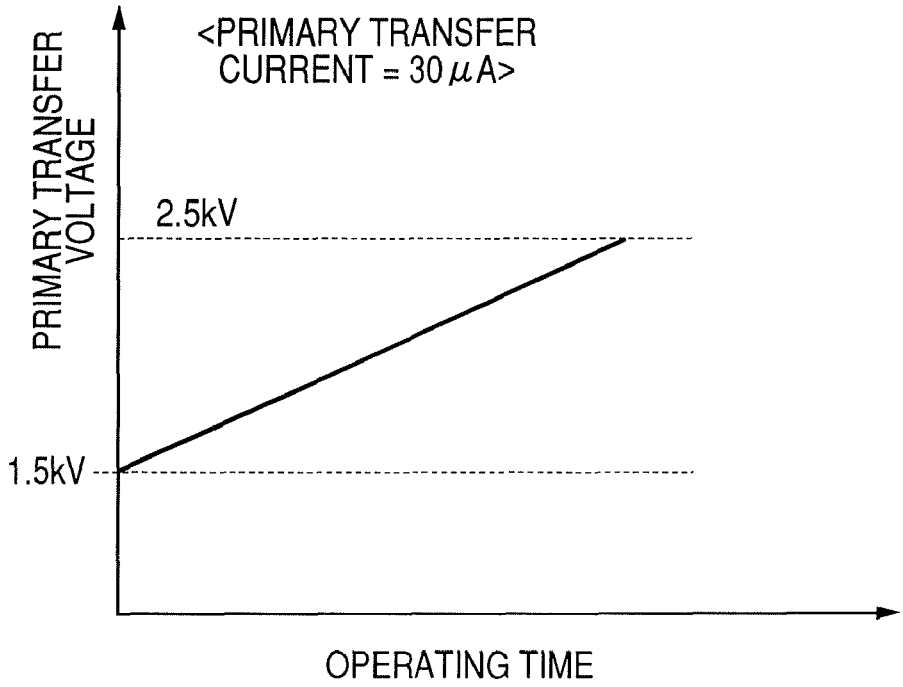
FIG. 5 is a diagram for describing a relation between an operating time and a primary transfer bias voltage.
Figure 6:
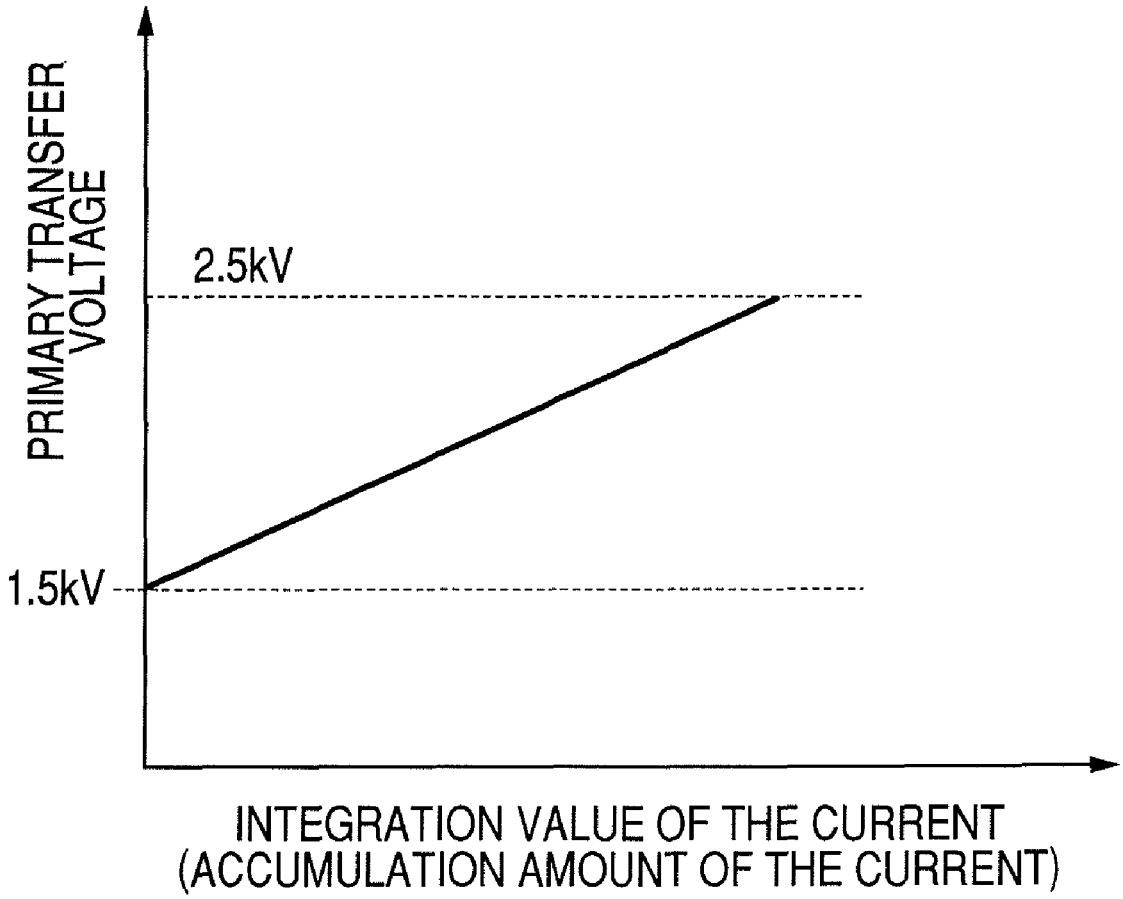
FIG. 6 is a diagram for describing a relation between a current supply accumulation charge amount and the primary transfer bias voltage.

FIG. 1 is a diagram for describing a construction of the main portion of the full-color image forming apparatus of the embodiment. FIG. 2 is a diagram for describing a positional relation between a transfer toner image on the intermediate transfer belt and a patch toner image for concentration detection. FIG. 3 is a diagram for describing primary transfer currents in the transfer toner image and the patch toner image for concentration detection. FIG. 4 is a diagram for describing a relation between the primary transfer current and transfer efficiency. FIG. 5 is a diagram for describing a relation between an operating time and a primary transfer bias voltage. FIG. 6 is a diagram for describing a relation between a current supply accumulation charge amount and the primary transfer bias voltage.

As illustrated in FIG. 1, an image forming apparatus 100 has a photosensitive drum 1 which rotates in a direction shown by an arrow A. A primary charging device 2, an exposing device 3, a developing device rotary 8, a primary transfer roller 15, and a drum cleaning device 19 are arranged around the photosensitive drum 1. A toner image forming unit is constructed by the primary charging device 2, exposing device 3, developing device rotary 8, and primary transfer roller 15.

The primary charging device 2 is constructed by a corona discharging apparatus to which a charging bias voltage has been applied. The primary charging device 2 uniformly charges a surface of the rotating photosensitive drum 1 to a negative polarity. An electric potential sensor 22 arranged between the primary charging device 2 and the developing device rotary 8 detects an electric potential of the rotating photosensitive drum 1 and feeds back to the charging bias voltage of the primary charging device 2.

The exposing device 3 forms an electrostatic latent image according to image information by a well-known electrophotographic process in which a laser beam which has been pulse-modulated based on the image information is scanned and exposed onto the surface of the photosensitive drum 1.

The developing device rotary 8 rotates developing devices 4 to 7 corresponding to the colors of yellow (Y), magenta (M), cyan (C), and black (K) so as to be located at the developing positions of the photosensitive drum 1. Each of the developing devices 4 to 7 has toner which has been charged to a negative polarity. By applying a developing voltage of the negative polarity to the developing devices 4 to 7, the electrostatic latent image of each color formed on the photosensitive drum 1 is developed and toner images of yellow, magenta, cyan, and black are sequentially formed.

The photosensitive drum 1 is made of a material which is charged to the negative polarity. The development which is executed by the developing devices 4 to 7 is performed based on an inversion developing system. Therefore, all of the toner which is used in the developing devices 4 to 7 is charged to the negative polarity.

The primary transfer roller (primary transfer unit) 15 comes into pressure contact with a primary transfer position (primary transfer portion) N1 of the photosensitive drum (image bearing member) 1 through an intermediate transfer belt (intermediate transfer member) 9. In the primary transfer roller 15, an elastic layer is arranged on an outer periphery of an axis made of stainless steel. A resistance adjusting agent, such as carbon, is dispersed into the elastic layer. A resistance of the primary transfer roller 15 is set to a value within a range from 1E+7 to 3E+7Ω (2 kV is applied). A primary transfer power source HV1 is controlled by a power controller (resistance adjusting unit) 301 in a control device 30 and outputs a primary transfer bias voltage of a polarity opposite to the charging polarity of the toner to the primary transfer roller 15. At the primary transfer position N1, the toner image is electrostatically transferred from the surface of the photosensitive drum 1 onto the intermediate transfer belt 9. In the embodiment, the primary transfer bias voltage of about +2000V is applied under constant voltage control and the primary transfer is executed by a primary transfer current of about 30 μA.

In the drum cleaning device (cleaning unit) 19, by allowing a blade 19*a* to slide on the surface of the photosensitive drum 1, the transfer residual toner deposited on the surface of the photosensitive drum 1 which has passed through the primary transfer position is scraped into a collecting container 19*b*.

In an intermediate transfer device 29, the intermediate transfer belt 9 is suspended around driven rollers 10 and 11, a tension roller 12, a secondary transfer inner roller 13, and a driving roller 14. The intermediate transfer belt 9 comes into contact with the primary transfer position N1 of the photosensitive drum 1, is driven by the driving roller 14 connected to a driving system (not shown), and is rotated in the direction shown by an arrow B. The intermediate transfer belt 9 is made of a resin, such as polyimide, polycarbonate, polyester, polypropylene, polyethylene terephthalate, acryl, vinyl chloride, or various kinds of rubber as a main material and is molded so as to have a thickness of 0.07 to 0.1 mm. A proper amount of an ion conductive material, such as carbon black, sodium perchlorate, or the like, is preliminarily contained as a conductive material into those main materials so that a volume resistivity lies within a range from 1E+8 to 1E+13Ω·cm.

The driven rollers 10 and 11 are suspending rollers made of metal which are arranged near the primary transfer position N1 of the photosensitive drum 1 and form a flat primary transfer surface of the intermediate transfer belt 9. The tension roller 12 controls the tension of the intermediate transfer belt 9 so as to be constant. The driven rollers 10 and 11, tension roller 12, and driving roller 14 are connected to a ground potential.

The secondary transfer inner roller 13 comes into pressure contact with a secondary transfer outer roller 16 through the intermediate transfer belt 9, thereby forming a secondary transfer position (secondary transfer portion) N2 between the secondary transfer outer roller 16 and the intermediate transfer belt 9. The secondary transfer inner roller 13 is a roller made of stainless steel. In the secondary transfer outer roller 16, an elastic layer is arranged on an outer periphery of an axis made of stainless steel. A resistance adjusting agent is dispersed into the elastic layer. A resistance of the secondary transfer outer roller 16 is set to a value within a range from 1E+7 to 3E+7Ω (2 kV is applied).

The secondary transfer outer roller 16 is connected to the ground potential. A secondary transfer bias voltage of the same polarity as the charging polarity of the toner is applied to the secondary transfer inner roller (secondary transfer unit) 13 from a secondary transfer power source HV2 which is controlled by the power controller 301 in the control device 30. Thus, the roller 13 moves the toner image held on the surface of the intermediate transfer belt 9 onto a recording material 20. In the embodiment, the secondary transfer bias voltage of about −2000V is applied under the constant voltage control and the secondary transfer is executed by a secondary transfer current of about −40 μA.

The recording materials (recording sheets) 20 are taken out one-by-one from a sheet feeding apparatus (not shown) arranged under a registration roller 17. The recording material is temporarily positioned and stopped by the registration roller 17 and held in a standby state. The registration roller 17 sends the recording material 20 to the secondary transfer position (secondary transfer portion) N2 at a timing matched with a head of the toner image on the intermediate transfer belt 9. Almost simultaneously with the timing when the recording material 20 has entered the secondary transfer position, the foregoing secondary transfer bias voltage is output from the secondary transfer power source HV2 to the secondary transfer inner roller 13.

A belt cleaning device (cleaning unit, resistance adjusting unit) 21 for electrostatically removing the transfer residual toner deposited on the intermediate transfer belt 9 after the secondary transfer is provided on the downstream side of the secondary transfer position N2 of the intermediate transfer belt 9. As fur brushes 21*a* and 21*b*, brushes in which a fur length is equal to 5 mm, a core diameter is equal to 8 mm, an outer diameter is equal to 18 mm, and a resistance value lies within a range from 1E+7 to 1E+8Ω when it is measured in N/N (23° C., 50% RH) by applying 100V are used.

A cleaning bias voltage of the same polarity as the charging polarity of the toner is applied from a cleaning power source HV4 to the fur brush 21*b* on the upstream side. A cleaning bias voltage of the polarity opposite to the charging polarity of the toner is applied from a cleaning power source HV3 to the fur brush 21*a* on the downstream side. Thus, the secondary transfer residual toner in which toner particles whose charging states have been inverted at the secondary transfer position N2 of the intermediate transfer belt 9 and other toner particles mixedly exist is cleaned.

The belt cleaning device 21 is constructed in such a manner that the fur brushes 21*a* and 21*b* come into contact with a metal roller (not shown) on the opposite side of the intermediate transfer belt 9 and the cleaning bias voltages are applied from the cleaning power sources HV3 and HV4 to the metal roller. The metal roller is rotated and the toner is scraped by the cleaning blade which slides on the surface and is collected into the collecting container. Since such a construction has been disclosed in detail in Japanese Patent Application Laid-Open No. 2005-808931, it is simply illustrated in FIG. 1.

The secondary transfer outer roller 16 and the belt cleaning device 21 can be come into contact with or can be separated from the intermediate transfer belt 9. In the step of circulating the intermediate transfer belt 9, primarily transferring the toner images of the respective colors from the photosensitive drum 1, and overlaying them, the secondary transfer outer roller 16 and the belt cleaning device 21 are separated from the intermediate transfer belt 9, thereby avoiding the contact with the toner images.

After the toner image of the final color (black) was primarily transferred at the primary transfer position N1 of the photosensitive drum 1, the secondary transfer outer roller 16 and the belt cleaning device 21 come into contact with the intermediate transfer belt 9, thereby preparing for the secondary transfer of the toner images.

White detecting seals SA and SB are adhered to the front side and the rear side of the back surface of the intermediate transfer belt 9 at phase positions of one circumference which are shifted by 180°. I-Top detecting sensors 24 for detecting the detecting seals SA and SB are arranged on the front side and the rear side so as to face the back surface of the intermediate transfer belt 9 between the driven roller 10 and the driving roller 14. The control device 30 starts the creation of the toner images on the photosensitive drum 1 by using the timing when the I-Top detecting sensors 24 detect either the detecting seal SA or SB as a start point.

In other words, between the detecting seals SA and SB, the detecting seal detected earlier by the I-Top detecting sensors 24 after a main motor of the image forming apparatus 100 had been made operative is used as a reference of a time base, and the writing of the electrostatic latent image by the exposing device 3 is started. Thus, since the toner images of the respective colors which are formed on the photosensitive drum 1 are always primarily transferred to the same position on the intermediate transfer belt 9, a deviation (color drift) of the toner images of the respective colors which have primarily been transferred and overlaid onto the surface of the intermediate transfer belt 9 in order is reduced.

A patch detecting sensor (detecting unit) 23 is arranged so as to face the photosensitive drum 1 on the downstream side of the developing device rotary 8. The patch detecting sensor 23 is a measuring device of an infrared reflection light amount having a light emitting unit and a photosensor unit. The patch detecting sensor 23 detects an infrared reflectance of a patch toner image for concentration detection of each color formed on the photosensitive drum 1. The control device 30 detects an output of the patch detecting sensor 23, discriminates the concentration of the patch toner image for the concentration detection of each color, and adjusts an amount of toner which is supplemented to the developing devices 4 to 7, a developing bias voltage, and a charging bias voltage based on a discrimination result. Thus, the concentration of the toner image of each color is stabilized, thereby assuring reproducibility of a color balance.

The patch toner image for the concentration detection is formed by a method whereby a non-image portion which has been formed on the photosensitive drum 1 and corresponds to an interval between the recording sheets is allowed to have a predetermined size and the electrostatic latent images of predetermined gradations are written by the exposing device and developed by the developing devices 4 to 7. The patch detecting sensor 23 starts the operation after a conveyance distance of a predetermined count value from the detection of the detecting seals SA and SB, thereby detecting the patch toner image for the concentration detection which passes through the opposite position of the patch detecting sensor 23. After the detection, an image condition controller (toner image forming condition controller) 302 in the control device 30 adjusts toner image forming conditions such as amount of toner which is supplemented to the developing devices 4 to 7, developing bias voltage, and charging bias voltage based on the detection result of the patch detecting sensor 23.

The primary transfer power source HV1 is controlled by the primary transfer power controller 301 in the control device 30 and applies a non-transfer bias voltage (−200V) of the same polarity as the charging polarity of the detecting toner to the primary transfer roller 15 after the elapse of a predetermined time after the detection of the detecting seals SA and SB. At this time, the non-transfer bias voltage is applied while the patch toner image for the concentration detection passes through the primary transfer position N1. A transfer current flowing to the primary transfer position N1 is equal to 0 μA. Thus, the patch toner image for the concentration detection which passes through the primary transfer position N1 of the photosensitive drum 1 is not transferred onto the intermediate transfer belt 9. The patch toner image for the concentration detection which passed through the primary transfer position N1 without being transferred onto the intermediate transfer belt 9 is removed from the surface of the photosensitive drum 1 by the drum cleaning device 19.

As illustrated in FIG. 2, the transfer toner images of the colors are positioned to the phase positions on the intermediate transfer belt 9 of the two patterns using each of the detecting seals SA and SB as a reference and primarily transferred. If the detecting seal SA is detected earlier by the I-Top detecting sensors 24, the detecting seal SB is used as a start point and the normal toner image is also primarily transferred in an interval where the patch toner image for the concentration detection is formed. On the contrary, if the detecting seal SB is detected earlier, the detecting seal SA is used as a start point and the normal toner image is also primarily transferred in an interval where the patch toner image for the concentration detection is formed.

Since the patch toner image for the concentration detection of each color is formed in the interval between the recording sheets of the predetermined distance away from the transfer toner image of each color, the patch toner image for the concentration detection of each color is also formed in the same position on the intermediate transfer belt 9. The non-transfer bias voltage (−200V) adapted to avoid the patch toner image for the concentration detection from being transferred onto the intermediate transfer belt 9 is applied every time to the same interval on the intermediate transfer belt 9 corresponding to the patch toner image for the concentration detection. At this time, the non-transfer bias voltage is applied to the intermediate transfer belt 9 through the primary transfer roller 15.

However, it has been found that if the non-transfer bias voltage (−200V) is continuously applied to the same interval on the intermediate transfer belt 9, the concentration of the transfer toner image which has primarily been transferred in this interval on the intermediate transfer belt 9 decreases. In other words, when the image creation using the detecting seal SA as a reference is switched to the image creation using the detecting seal SB as a reference, the concentration of the transfer toner image which has primarily been transferred to a region F on the intermediate transfer belt 9 corresponding to the patch toner image for the concentration detection using the detecting seal SA as a reference decreases. On the contrary, when the reference is switched from the detecting seal SB to the detecting seal SA, the concentration of the transfer toner image decreases in a region E corresponding to the patch toner image for the concentration detection using the detecting seal SB as a reference.

As illustrated in FIG. 3, although a primary transfer current is equal to a target value of 30 μA in the outside of the regions E and F, the primary transfer current is increased to 40 μA in the regions E and F of the intermediate transfer belt 9 with which the patch toner image for the concentration detection is in contact.

As illustrated in FIG. 4, in the image forming apparatus 100, when the primary transfer current is equal to 30 μA, the transfer efficiency becomes maximum. When the primary transfer current is equal to 40 μA, the transfer efficiency deteriorates and the concentration of the toner image which is primarily transferred onto the intermediate transfer belt 9 decreases. Therefore, in the regions E and F where the primary transfer current is equal to 40 μA, the concentration of the toner image on the intermediate transfer belt 9 is smaller than that in the outside region where the primary transfer current is equal to 30 μA. When a discontinuous concentration difference occurs at a boundary between the regions E and F of the intermediate transfer belt 9, even if a concentration difference between the inside and the outside of each of the regions E and F is fairly small, such a portion becomes conspicuous as a concentration variation or a color drift of the image formed on the recording material 20.

As illustrated in FIG. 5, when an operating time (durability time) of the image forming apparatus 100 becomes long, the primary transfer voltage necessary for allowing the primary transfer current of 30 μA to flow increases gradually. That is, as illustrated in FIG. 6, a load impedance at the primary transfer position N1 increases in proportion to an amount obtained by integrating the current flowing in a unit area of the intermediate transfer belt 9 at the primary transfer position N1 by the time (such an amount is hereinbelow called an accumulation amount of the current). The load impedance is a resistance value in the thickness direction of the intermediate transfer belt 9. The load impedance increases because an impedance of the intermediate transfer belt 9 rises according to the accumulation amount of the current. Particularly, when a material in which the conductive material of the ion conductivity has been dispersed into the composition is used, if the voltage is repetitively applied in one direction, the charged substance concerned with the conduction in the composition is moved and deviated and a portion having a small density occurs. In such a case, therefore, the increase in load impedance is remarkable.

In the image forming apparatus 100, the bias voltage of the same polarity as that of the toner is applied to the primary transfer roller 15 synchronously with the timing when the patch toner image for the concentration detection formed on the photosensitive drum 1 passes through the primary transfer position N1. The interval of the intermediate transfer belt 9 which comes into contact with the patch toner image for the concentration detection has been predetermined to the position in either the region E or F by the detecting seals SA and SB.

Therefore, in the regions E and F, since the voltage of the polarity different from that of the outside portion of each of the regions E and F is applied, the accumulation amount of the current illustrated in FIG. 6 is smaller than that of another portion and an increasing rate in the impedance in each of the regions E and F decreases.

Consequently, if the regions E and F whose impedance is smaller than that of the outside region are handled integratedly with the outside region and the toner images are primarily transferred, the primary transfer current becomes surplus in the regions E and F and the concentration of the toner image decreases.

First Embodiment

Figure 7:
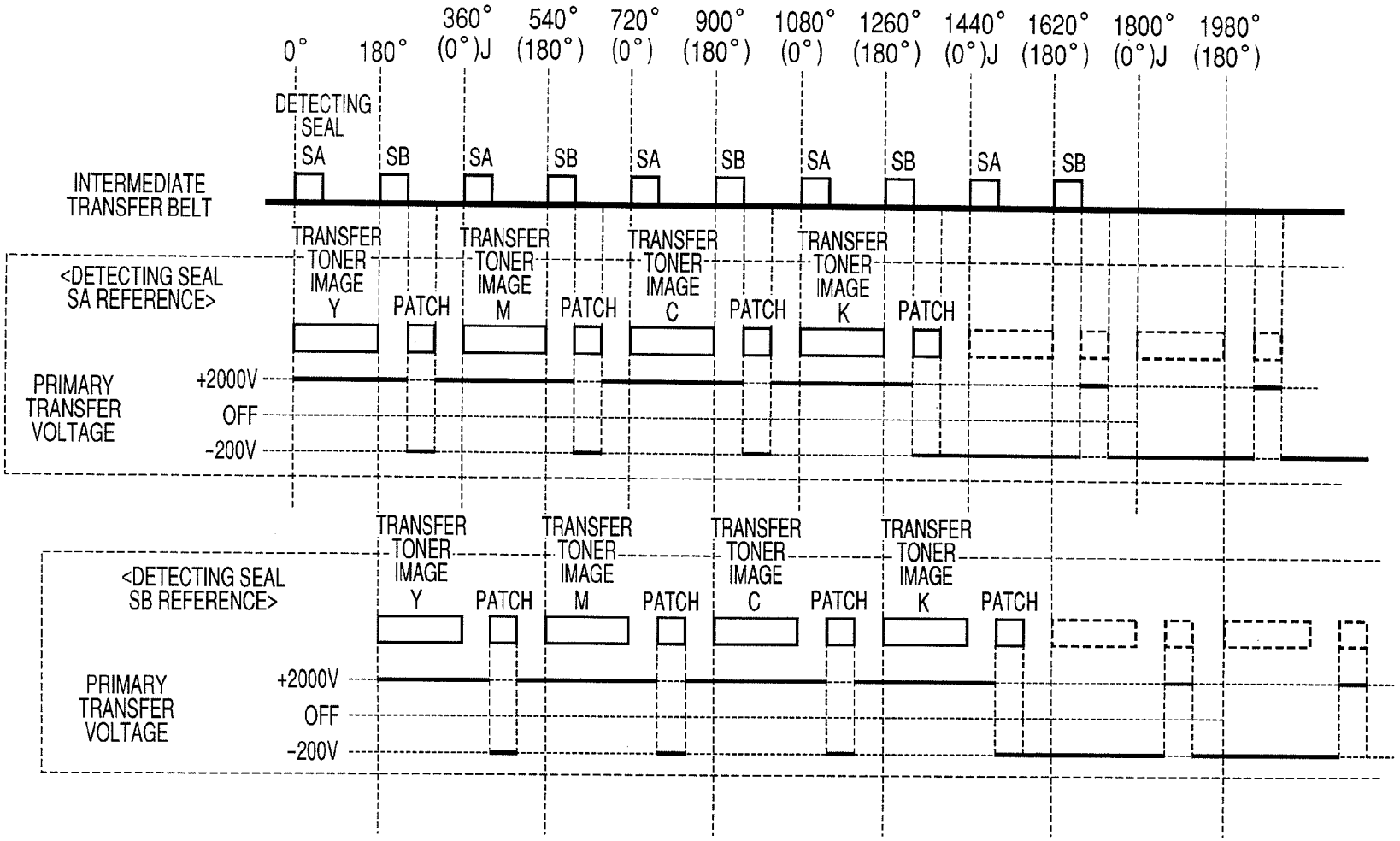
FIG. 7 is a time chart for control in the first embodiment.

FIG. 7 is a time chart for control in the first embodiment. In the first embodiment, in the post-rotation of each job, a voltage in no toner image state is applied (that is, a bias voltage is applied in a state where no toner images are formed on the photosensitive drum: hereinbelow, such a state is expressed as "voltage is applied in a no toner image state") only in the region E (or F: FIG. 2) of the intermediate transfer belt 9 by using the primary transfer roller 15, thereby locally increasing the impedance.

As illustrated in FIG. 1, between the two detecting seals SA and SB adhered to the back surface of the intermediate transfer belt 9, the seal on the front side is called a detecting seal SA and the seal on the rear side is called a detecting seal SB. The main motor is made operative synchronously with the signal to start the image creation. Assuming that the detecting seal detected earlier by the I-Top detecting sensors 24 is, for example, the detecting seal SA, the detecting seal SA is used as a reference time base and the photosensitive drum 1 is charged by the primary charging device 2 so that its electric potential is equal to a photosensitive drum potential for the Y toner image. Subsequently, the exposing device 3 forms an electrostatic latent image for the Y toner image and an electrostatic latent image for the Y patch toner image. The developing device 4 develops the electrostatic latent images. Thus, the transfer toner image and the patch toner image for the concentration detection of yellow (Y) are formed on the photosensitive drum 1.

Subsequently, as illustrated in FIG. 7, the primary transfer power source HV1 applies the primary transfer bias voltage (+2000V) by the primary transfer roller 15 to the transfer toner image which is primarily transferred onto the intermediate transfer belt 9. The primary transfer power source HV1 applies the non-transfer bias voltage (−200V) to the patch toner image for the concentration detection. Thus, as mentioned above, while the transfer toner image is primarily transferred onto the intermediate transfer belt 9 accompanied by the primary transfer current of +30 μA, the patch toner image for the concentration detection remains on the photosensitive drum 1 and is conveyed to the drum cleaning device 19.

After that, the apparatus waits until the detecting seal SA is detected again by the I-Top detecting sensor 24, and repeats processes similar to those mentioned above with respect to the transfer toner image and the patch toner image for the concentration detection of magenta (M). Similar processes are also repeated with respect to the transfer toner images and the patch toner image for the concentration detection of cyan (C) and black (K).

By the above operation, the transfer toner images of yellow (Y), magenta (M), cyan (C), and black (K) are overlaid onto the intermediate transfer belt 9 and the full-color transfer toner image is formed. The full-color transfer toner image is conveyed to the secondary transfer position N2. By applying the secondary transfer bias voltage from the secondary transfer power source HV2 to the secondary transfer inner roller 13, the full-color transfer toner image is secondarily transferred onto the recording material 20 accompanied by the secondary transfer current of −40 μA.

After that, such a post-rotation that the photosensitive drum 1 is rotated without forming the transfer toner images onto the photosensitive drum 1 and the intermediate transfer belt 9 is circulated is executed. As illustrated in FIG. 7, in the case where the transfer toner images and the patch toner image for the concentration detection are formed by using the detecting seal SA as a start point, the post-rotation is executed after the primary transfer roller 15 came out of the patch toner image for the concentration detection existing on the front side by 1440°. In the case where the transfer toner images and the patch toner image for the concentration detection are formed by using the detecting seal SB as a start point, the post-rotation is executed after the primary transfer roller 15 came out of the patch toner image for the concentration detection existing on the front side by 1620°. In the post-rotation, while the intermediate transfer belt 9 rotates once, the patch toner image for the concentration detection is repetitively formed upon image creation. The primary transfer bias voltage (+2000V) is applied to the interval where the non-transfer bias voltage (−200V) has repetitively been applied. The electric potential in this interval is set to +2000V as a second correction potential. On the contrary, the non-transfer bias voltage (−200V) is applied to the interval where the primary transfer bias voltage (+2000V) has repetitively been applied upon image creation. The electric potential in this interval is set to −200V as a first correction potential.

Thus, the resistance difference in the thickness direction which occurred upon image creation is set off at the time of the post-rotation and corrected to a uniform resistance value in the thickness direction over the whole length of the intermediate transfer belt 9.

The primary transfer bias voltage and the non-transfer bias voltage adapted to correct the resistance value are output from the primary transfer power source HV1 which is controlled by the power controller 301 and applied from the primary transfer roller 15 to the intermediate transfer belt 9.

In other words, among the positions 360*(N−1)° (N: natural number) of the intermediate transfer belt 9 in which the detecting seal SA is used as a reference time base, the primary transfer bias voltage (+2000V) is applied to the portion which has come into contact with the patch toner image for the concentration detection at a position after 1440° during the post-rotation, and the primary transfer current of +30 μA which is not accompanied with the transfer is allowed to flow. The non-transfer bias voltage (−200V) is applied to the interval which has not been brought into contact with the patch toner image for the concentration detection at a position after 1440° during the post-rotation, and the primary transfer current of −3 μA is allowed to flow. Thus, as illustrated in FIG. 6, the accumulation amount of the current in the interval where the non-transfer bias voltage (−200V) has repetitively been applied increases and a difference between the accumulation amount of the current in such an interval and the current accumulation amount in the interval before/after such an interval is reduced. Consequently, a difference between the impedance in such an interval and the impedance in the interval before/after such an interval is reduced. Even in the interval where the non-transfer bias voltage (−200V) has repetitively been applied, the same primary transfer current and transfer efficiency can be assured by the same primary transfer bias voltage as that in the interval before/after such an interval.

According to the control of the first embodiment, when the patch toner image for the concentration detection passes through the primary transfer position N1, the primary transfer current in the same direction as that of the primary transfer current upon image creation is allowed to selectively flow at another timing to the interval of the intermediate transfer belt 9 through which the patch toner image has likewise passed. Thus, a current supply deterioration speed (impedance rising speed to the operating time) of such an interval is set to be equal to that of the interval of the intermediate transfer belt 9 on which the transfer toner images have been held upon image creation, thereby reducing the impedance variation in the conveying direction of the intermediate transfer belt 9.

In other words, a deviation between the accumulation amount of the current in the portion which holds the transfer toner images on the intermediate transfer belt 9 and the current accumulation amount in the portion which has come into contact with the patch toner image for the concentration detection is decreased. Therefore, the impedance variation in the conveying direction of the intermediate transfer belt which occurs due to the difference between the accumulation amounts of the currents is reduced. That is, the different voltages are applied to the interval where the patch toner image for the concentration detection has been formed and the interval where it is not formed so as to decrease the difference between the impedance in the interval where the voltage of the same polarity as that of the toner image has been applied in association with the passage of the patch toner image for the concentration detection through the primary transfer position N1 and the impedance in the interval before/after such an interval.

Consequently, even if the image creation is started by using any one of the detecting seals SA and SB as a reference time base, the transfer fluctuation that is caused by the impedance variation of the intermediate transfer belt 9 does not occur. The concentration variation and the color drift due to the impedance variation of the intermediate transfer belt 9 are suppressed and the stable full-color image of high quality can be formed.

In the control illustrated in FIG. 7, the intermediate transfer belt 9 has been rotated twice in the post-rotation and the primary transfer bias voltage has been applied twice to the portion with which the patch toner image for the concentration detection has been come into contact. However, the number of times of applying the primary transfer bias voltage to the same portion can be also increased by further rotating the belt 9. Thus, by applying the primary transfer bias voltage and the non-transfer bias voltage to both intervals the same number of times at the time of the image creation and the post-rotation, a difference of the transfer currents between both of those intervals can be also set off. In the case where the transfer bias voltage whose absolute value is larger than the ordinary transfer bias voltage is applied to the interval with which the patch toner image for the concentration detection has come into contact and the impedance is increased at an accelerated pace, the number of rotating times of the intermediate transfer belt 9 in the post-rotation can be also set to one.

In the control illustrated in FIG. 7, the operation is provided for the post-rotation each time one full-color image is output and the primary transfer bias voltage is applied to the portion which is in contact with the patch toner image for the concentration detection. However, in the case of outputting a plurality of full-color images by continuous jobs, after all of the jobs were finished, the post-rotation operation accompanied with the application of the primary transfer bias voltage in the no toner image state may be started. That is, after all of a plurality of images were output, the operation after 1440° of the intermediate transfer belt position as illustrated in FIG. 7 may be executed.

Also in the case where the detecting seal detected earlier by the I-Top detecting sensors 24 is the detecting seal SB, similarly, the seal SB is used as a reference and control similar to that in the case of using the seal SA as a reference time base is made. However, since the position of the detecting seal SA on the intermediate transfer belt 9 and the position of the detecting seal SB are different by one-half circumference, as illustrated in FIG. 7, the phases of the operations in this instance when seen from the intermediate transfer belt 9 are also different by 180°.

Second Embodiment

Figure 8:
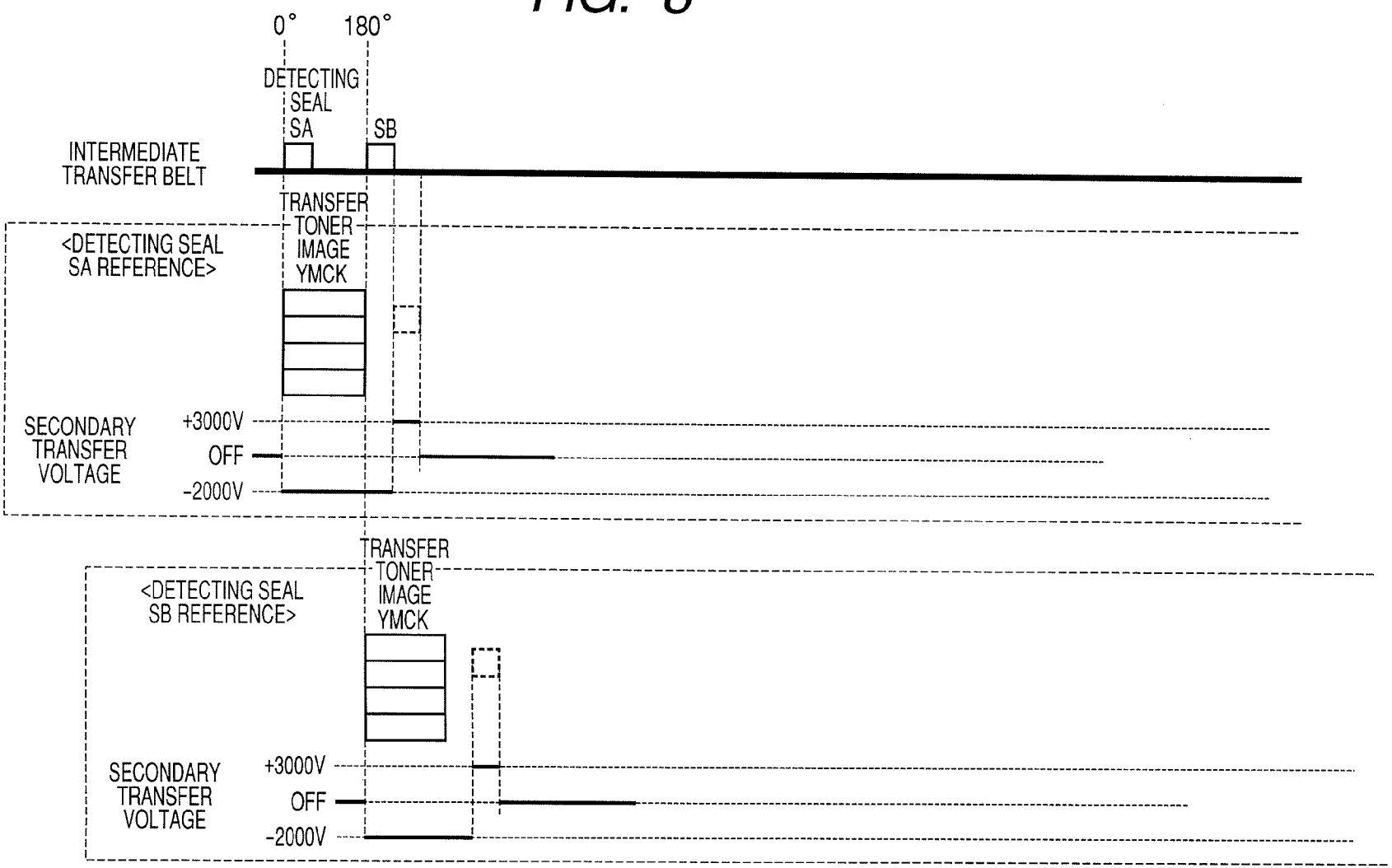
FIG. 8 is a time chart for control in the second embodiment.

FIG. 8 is a time chart for control in the second embodiment. In the second embodiment, an impedance is locally increased by applying a high voltage only to the region E (or F: FIG. 2) of the intermediate transfer belt 9 by using the secondary transfer inner roller 13. In the control of the second embodiment, portions common to those in the first embodiment will be described with reference to FIG. 7.

It is now assumed that the main motor is made operative synchronously with the image creation start signal and the detecting seal SA on the front side has been detected first by the I-Top detecting sensors 24. As illustrated in FIG. 7, the seal SA is used as a reference time base and the transfer toner image and the patch toner image for the concentration detection of yellow (Y) are formed on the photosensitive drum 1. The transfer toner image is primarily transferred onto the intermediate transfer belt 9 by applying the primary transfer bias voltage (+2000V) to the primary transfer roller 15. However, the patch toner image for the concentration detection is allowed to remain on the photosensitive drum 1 by applying the non-transfer bias voltage (−200V) to the primary transfer roller 15 and is removed by the drum cleaning device 19. After that, the apparatus waits until the detecting seal SA is detected by the I-Top detecting sensors 24, and repeats the similar processes with respect to magenta (M), cyan (C), and black (K), thereby forming the full-color transfer toner image onto the intermediate transfer belt 9.

As illustrated in FIG. 8, the full-color transfer toner image is conveyed to the secondary transfer position N2 together with the intermediate transfer belt 9, sandwiched between the secondary transfer inner roller 13 and the secondary transfer outer roller 16 together with the recording material 20, and conveyed. At the same time, by applying the secondary transfer bias voltage (−2000V) to the secondary transfer inner roller 13 from the secondary transfer power source HV2, the full-color transfer toner image is secondarily transferred onto the recording material 20 accompanied by the secondary transfer current of −40 μA.

The post-rotation is started just after the recording material 20 has passed through the secondary transfer position N2. While the interval of the intermediate transfer belt 9 which has been come into contact with the patch toner image for the concentration detection passes through the secondary transfer position N2, the bias voltage (+3000V) is applied, thereby forcedly allowing the current of +80 μA to flow.

Thus, as illustrated in FIG. 6, the accumulation amount of the current in the interval where the non-transfer bias voltage (−200V) has been applied by using the primary transfer roller 15 increases. The difference between the impedance in such an interval and the impedance in the interval before/after such an interval is reduced. Thus, even in the interval where the non-transfer bias voltage (−200V) has been applied, the same primary transfer current and transfer efficiency can be assured by the same primary transfer bias voltage as that in the interval before/after such an interval.

In other words, the deviation between the accumulation amount of the current in the interval where the transfer toner images have been held on the intermediate transfer belt 9 and the current accumulation amount in the interval which has been come into contact with the patch toner image for the concentration detection can be decreased as illustrated in FIG. 6. Therefore, the impedance variation in the conveying direction of the intermediate transfer belt 9 which occurs due to the difference between the accumulation amounts of the currents is reduced.

Consequently, even if the image creation is started by using any one of the detecting seals SA and SB as a reference time base, the impedance variation of the intermediate transfer belt 9 is suppressed and the image without the concentration variation which is caused by the transfer fluctuation is obtained.

In the control illustrated in FIG. 8, the bias voltage (+3000V) has locally been applied once to the interval which has been come into contact with the patch toner image for the concentration detection. However, the number of times of applying the bias voltage to the same interval can be also increased by further rotating the intermediate transfer belt 9 several times.

In the control illustrated in FIG. 8, the post-rotation including the application of the bias voltage is executed each time one full-color image is output. However, in the continuous jobs for outputting a plurality of full-color images, after all of the jobs were finished, a similar post-rotation may be executed.

When the detecting seal SB is detected first by the I-Top detecting sensors 24, the detecting seal SB is used as a reference time base and similar control is made. However, since the phase positions of the detecting seals SA and SB on the intermediate transfer belt 9 are different by 180°, as illustrated in FIG. 8, the phases of the operations when seen from the intermediate transfer belt 9 are also different by 180°.

Third Embodiment

Figure 9:
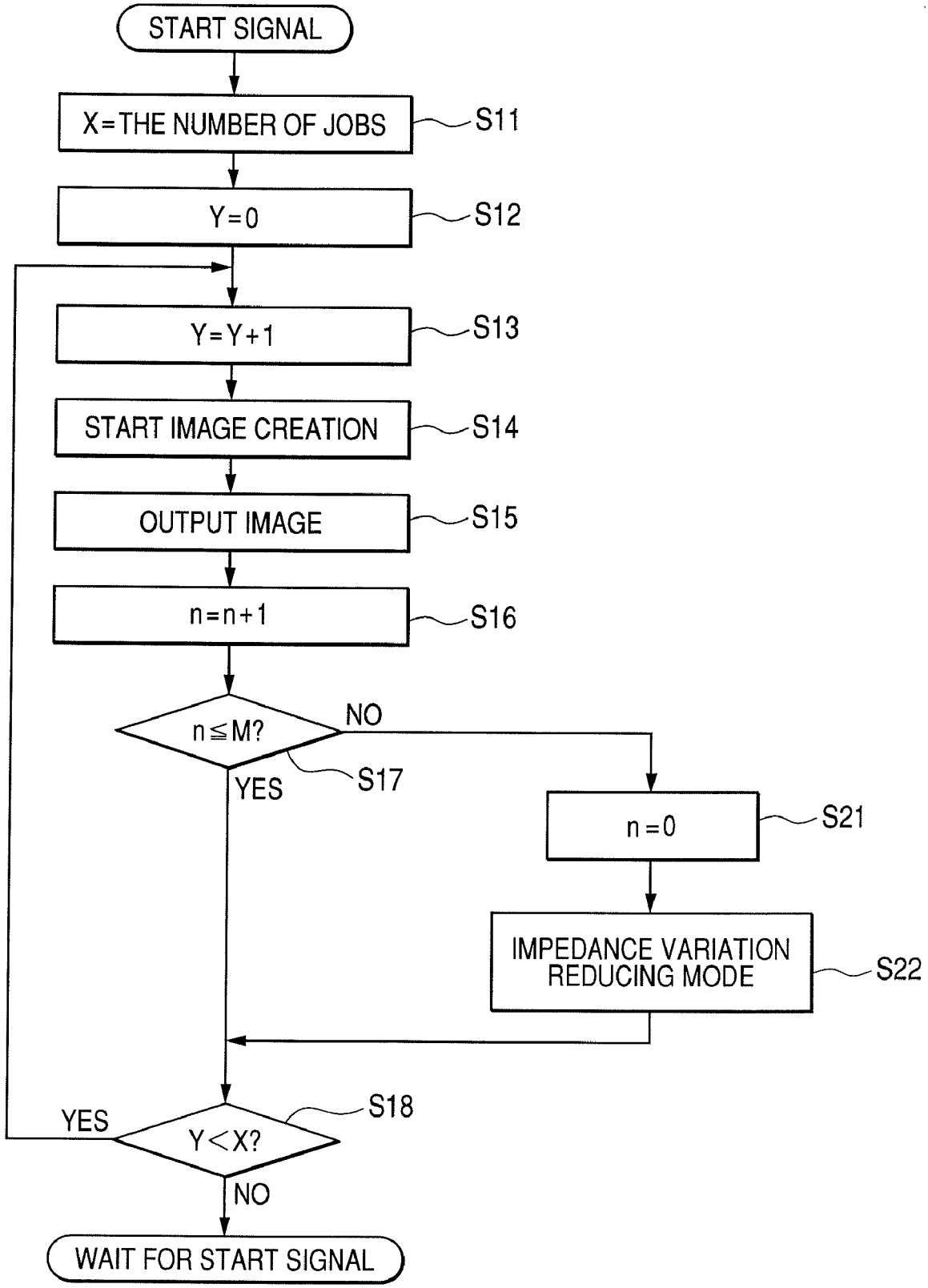
FIG. 9 is a flowchart for control in the third embodiment.

FIG. 9 is a flowchart for control in the third embodiment. In the third embodiment, after completion of the execution of the previous impedance variation reducing mode, whenever the number (n) of accumulation output sheets of the image creation reaches the specific number of sheets (M=500), the present impedance variation reducing mode is executed. In the impedance variation reducing mode, by using the primary transfer roller 15, the primary transfer bias voltage is applied in the no toner image state to the interval of the intermediate transfer belt 9 which is in contact with the patch toner image for the concentration detection. Since the creation and the transfer/non-transfer of the transfer toner images and the patch toner images for the concentration detection are similar to those in the first embodiment, they will be described with reference to FIG. 7.

As illustrated in FIG. 7, it is now assumed that the main motor is made operative synchronously with the signal to start the image creation and the detecting seal SA on the front side has been detected first by the I-Top detecting sensors 24. The detecting seal SA is used as a reference time base and the transfer toner image and the patch toner image for the concentration detection of yellow (Y) are formed on the photosensitive drum 1. The transfer toner image is primarily transferred onto the intermediate transfer belt 9 by applying the primary transfer bias voltage (+2000V) to the primary transfer roller 15. However, the patch toner image for the concentration detection is allowed to remain on the photosensitive drum 1 by applying the non-transfer bias voltage (−200V) and is removed by the drum cleaning device 19. After that, the apparatus waits until the detecting seal SA is detected by the I-Top detecting sensors 24, and repeats similar processes with respect to magenta (M), cyan (C), and black (K), thereby forming the full-color transfer toner image onto the intermediate transfer belt 9.

When the detecting seal SB is detected first by the I-Top detecting sensors 24, the detecting seal SB is used as a reference time base and similar control is made. However, since the phase positions of the detecting seals SA and SB on the intermediate transfer belt 9 are different by 180°, as illustrated in FIG. 7, the phases of the operations when seen from the intermediate transfer belt 9 are also different by 180°.

The full-color transfer toner image is conveyed to the secondary transfer position (secondary transfer portion) N2 together with the intermediate transfer belt 9, sandwiched between the secondary transfer inner roller 13 and the secondary transfer outer roller 16 together with the recording material 20, and conveyed. At the same time, by applying the secondary transfer bias voltage (−2000V) to the secondary transfer inner roller 13 from the secondary transfer power source HV2, the full-color transfer toner image is secondarily transferred onto the recording material 20 accompanied by the secondary transfer current of −40 μA. Although the post-rotation is started after completion of the secondary transfer, in the post-rotation, the voltage in the no toner image state as in the first and second embodiments is not applied.

As illustrated in FIG. 9, when the image creation start signal is received, the control device 30 fetches the total number (X) of output sheets of the jobs (step S11) and resets the number (Y) of processed sheets (S12). "1" is added to the number (Y) of processed sheets (S13). The image creation is started as mentioned above (S14). The recording material 20 on which the image has been formed is output (S15).

In S16, "1" is added to the number (n) of accumulation output sheets which have been accumulated after the number (n) had been reset to 0 at the previous time (S21). Whether or not the number (n) of accumulation output sheets has reached the specific number of sheets (M=500) is discriminated (S17).

If the number (n) of accumulation output sheets is equal to or less than 500 (YES in S17), similar processes (S13 to S18)

are repeated until the number (Y) of processed sheets reaches the total number (X) of output sheets (YES in S18). However, when the number (Y) of processed sheets has reached the total number (X) of output sheets (NO in S18), the apparatus waits for the next job. That is, if the job is not finished, the image is continuously formed. If the job has been finished, the number (n) of accumulation output sheets is held and the apparatus waits for the next start signal.

When the number (n) of accumulation output sheets reaches 501 (NO in S17), the number (n) of accumulation output sheets is reset to 0 (S21) and the operation in the impedance variation reducing mode is executed (S22). After that, similar processes (S13 to S18) are repeated until the number (Y) of processed sheets reaches the total number (X) of output sheets (YES in S18). That is, when the number (n) of accumulation output sheets reaches the specific number of sheets (M=500) during image creation, the operation in the impedance variation reducing mode accompanied with the application of the voltage using the primary transfer roller 15 in the no toner image state is executed.

The operation in the impedance variation reducing mode is fundamentally the same as the process at the time of the post-rotation in the first embodiment. That is, image creation is inhibited in a manner similar to the case of the post-rotation after 1440° illustrated in FIG. 7. The detecting seal SA is used as a reference time base, the primary transfer bias voltage (+2000V) is applied in the no toner image state to the interval of the intermediate transfer belt 9 which has come into contact with the patch toner image for the concentration detection, and the transfer current of +30 μA is forcedly allowed to flow. Although the post-rotation is finished by two rotations in the control illustrated in FIG. 7, according to the third embodiment, in order to set off the impedance variation corresponding to the 500 output sheets, the number of times of applying the primary transfer bias voltage (+2000V) to the interval of the intermediate transfer belt 9 which has come into contact with the patch toner image for the concentration detection is increased by further rotating the drum. Consequently, the operating time of the impedance variation reducing mode becomes longer than that of the post-rotation in the first embodiment.

Thus, the deviation between the accumulation amount of the current in the interval which holds the transfer toner images on the intermediate transfer belt 9 and the current accumulation amount in the interval which has come into contact with the patch toner image for the concentration detection can be decreased as illustrated in FIG. 6. Therefore, the impedance variation in the conveying direction of the intermediate transfer belt 9 which occurs due to the difference between the accumulation amounts of the currents is reduced. Even if image creation is started by using any one of the detecting seals SA and SB as a reference time base, the impedance variation of the intermediate transfer belt 9 is suppressed and the image without the concentration variation which is caused by the transfer fluctuation is obtained.

Fourth Embodiment

Figure 10:
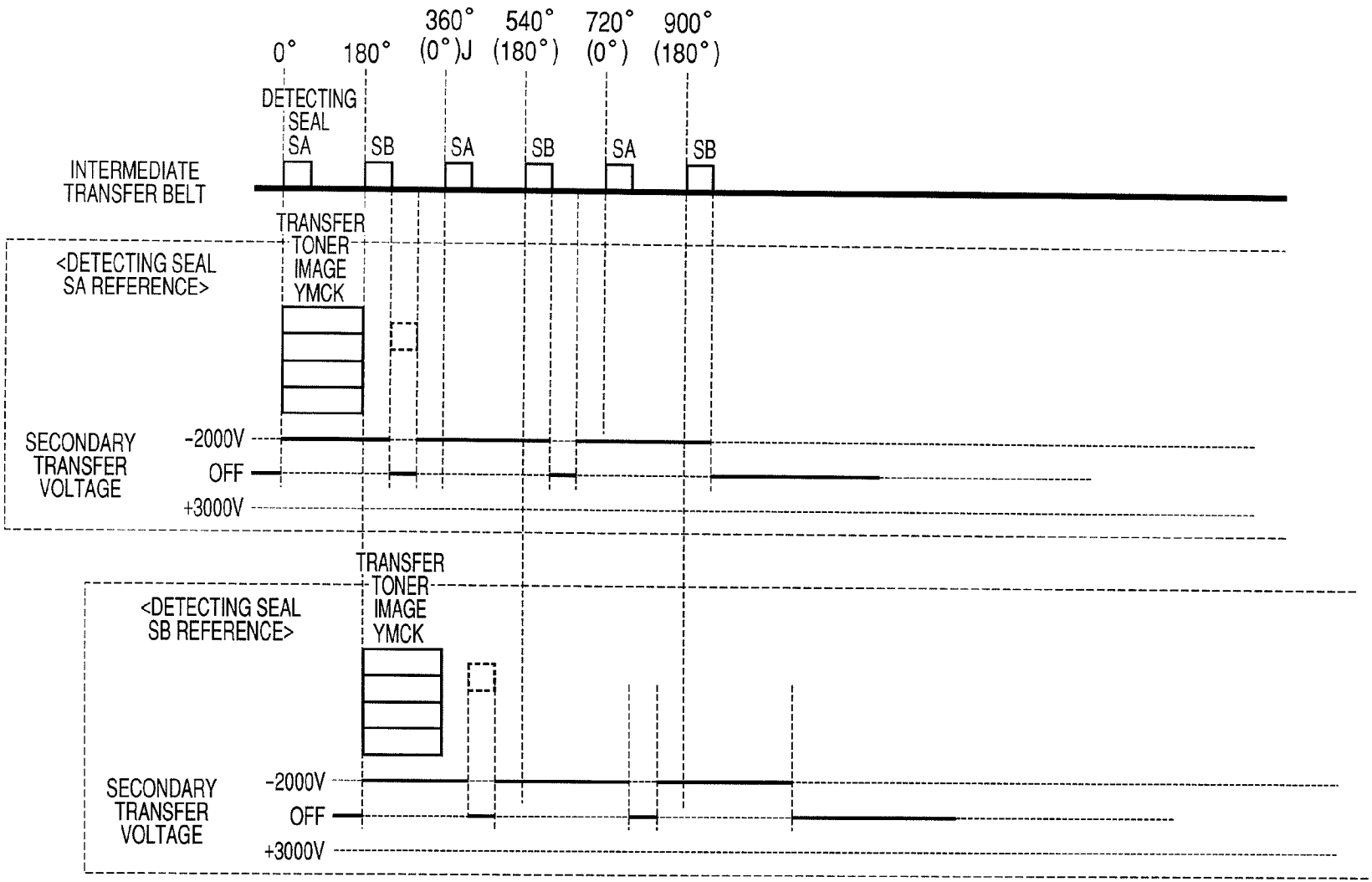
FIG. 10 is a time chart for control in the fourth embodiment.

FIG. 10 is a time chart for control in the fourth embodiment. In the fourth embodiment, the secondary transfer bias voltage (−2000V) is applied in the no toner image state to the interval of the intermediate transfer belt 9 which has not come into contact with the patch toner image for the concentration detection at the secondary transfer position N2 upon post-rotation, thereby making the impedance variation of the intermediate transfer belt 9 uniform. The impedance difference that is caused by the difference between the voltages applied to the intermediate transfer belt 9 at the primary transfer position N1 is set off by giving the voltage differences of the opposite directions on the inner and outer sides to the intermediate transfer belt 9 at the secondary transfer position N2. Since the creation and the transfer/non-transfer of the transfer toner images and the patch toner images for the concentration detection are similar to those in the first embodiment, they will be described with reference to FIG. 7.

As illustrated in FIG. 7, it is now assumed that the main motor is made operative synchronously with the image creation start signal and the detecting seal SA on the front side has been detected first by the I-Top detecting sensors 24. The detecting seal SA is used as a reference time base and the transfer toner image and the patch toner image for the concentration detection of yellow (Y) are formed on the photosensitive drum 1. The transfer toner image is primarily transferred onto the intermediate transfer belt 9 by applying the primary transfer bias voltage (+2000V) to the primary transfer roller 15. However, the patch toner image for the concentration detection is allowed to remain on the photosensitive drum 1 by applying the non-transfer bias voltage (−200V) and is removed by the drum cleaning device 19. After that, the apparatus waits until the detecting seal SA is detected by the I-Top detecting sensors 24, and repeats the similar processes with respect to magenta (M), cyan (C), and black (K), thereby forming the full-color transfer toner image onto the intermediate transfer belt 9. When the detecting seal SB is detected first by the I-Top detecting sensors 24, the detecting seal SB is used as a reference time base and similar control is made. However, since the phase positions of the detecting seals SA and SB on the intermediate transfer belt 9 are different by 180°, as illustrated in FIG. 10, the phases of the operations when seen from the intermediate transfer belt 9 are also different by 180°.

As illustrated in FIG. 1, the full-color transfer toner image is conveyed to the secondary transfer position N2 together with the intermediate transfer belt 9, sandwiched between the secondary transfer inner roller 13 and the secondary transfer outer roller 16 together with the recording material 20, and conveyed. At the same time, by applying the secondary transfer bias voltage (−2000V) to the secondary transfer inner roller 13 from the secondary transfer power source HV2, the full-color transfer toner image is secondarily transferred onto the recording material 20 accompanied by the secondary transfer current of −40 μA.

The post-rotation is started just after the recording material 20 has passed through the secondary transfer position N2. In the post-rotation, while the intermediate transfer belt 9 rotates once in the state where image creation by the photosensitive drum 1 is inhibited, the secondary transfer bias voltage (−2000V) is applied from the secondary transfer inner roller 13 to the interval of the intermediate transfer belt 9 excluding the interval with which the patch toner image for the concentration detection has come into contact. The electric potential of this interval is set to −2000V as a first correction potential. On the contrary, at the secondary transfer position N2, the current of about −50 μA flows in the intermediate transfer belt 9 to which the secondary transfer bias voltage (−2000V) has been applied. The secondary transfer bias voltage is turned off (0V is applied) for a period of time during which the interval which has come into contact with the patch toner image for the concentration detection passes through the secondary transfer position N2. The electric potential of this interval is set to 0V as a second correction potential.

In the post-rotation of the embodiment, the intermediate transfer belt 9 rotates twice. It is also possible to apply +200V as a non-transfer bias voltage for a period of time during which the interval which has come into contact with the patch toner image for the concentration detection passes through the secondary transfer position N2 and to set the electric potential of this interval to +200V.

The secondary transfer bias voltage and the non-transfer bias voltage adapted to correct the resistance value are output from the secondary transfer power source HV2 which is controlled by the power controller 301 and are applied to the intermediate transfer belt 9 from the secondary transfer inner roller 13.

Thus, the influence that is exerted by applying the primary transfer bias voltage (+2000V) at the primary transfer position N1 to the portion which holds the transfer toner images on the intermediate transfer belt 9 is set off by applying the secondary transfer bias voltage (−2000V) of the opposite directions on the inner and outer sides at the secondary transfer position N2. Therefore, the deviation between the accumulation amount of the current in the interval which holds the transfer toner images and the current accumulation amount in the interval which has come into contact with the patch toner image for the concentration detection can be reduced. Therefore, the impedance variation in the conveying direction of the intermediate transfer belt 9 which occurs due to the difference between the accumulation amounts of the currents is reduced.

Thus, even if image creation is started by using any one of the detecting seals SA and SB as a reference time base at the next time, since the impedance variation of the intermediate transfer belt 9 has been suppressed, the image without the concentration variation that is caused by the transfer fluctuation is obtained.

In the control illustrated in FIG. 10, the post-rotation which is executed after the secondary transfer of the transfer toner images is performed twice and the secondary transfer bias voltage is applied twice in the no toner image state to the interval which holds the transfer toner images. However, the secondary transfer bias voltage may be applied three or more times by further continuing the post-rotation.

Each time the transfer toner images are secondarily transferred once, the post-rotation is executed and the secondary transfer bias voltage is applied in the no toner image state to the interval which holds the transfer toner images. However, in the case of continuously executing the secondary transfer to a plurality of recording materials by the continuous jobs without executing the post-rotation, it is also possible to execute the post-rotation of the necessary number of rotating times after completion of the continuous jobs and apply the secondary transfer bias voltage the necessary number of applying times to the interval which holds the transfer toner images.

Fifth Embodiment

In the fifth embodiment, a high voltage is applied only to the region E (or F: FIG. 2) of the intermediate transfer belt 9 by using the belt cleaning device 21 illustrated in FIG. 1, thereby locally increasing the impedance.

As illustrated in FIG. 1, in all of the first to fourth embodiments, by using the existing voltage applying members and high voltage power source arranged along the intermediate transfer belt 9, in the primary transfer portion N1, the different voltages are applied to the interval which has been come into contact with the patch toner image for the concentration detection and the interval to which the transfer toner images have primarily been transferred.

Therefore, similar control can be made by using the fur brush 21*a* and the cleaning power source HV3 (or the fur brush 21*b* and the cleaning power source HV4). That is, in the primary transfer portion N1, the different voltages are applied in the no toner image state to the interval which has come into contact with the patch toner image for the concentration detection and the interval to which the transfer toner images have primarily been transferred. The impedance variation in the conveying direction of the intermediate transfer belt 9 can be reduced.

The timing when the detecting seal SA has been detected by the I-Top detecting sensors 24 is used as a start point and a conveyance distance of the intermediate transfer belt 9 is measured, thereby discriminating the period of time during which the interval where the non-transfer bias voltage (−200V) has been applied passes through the fur brush 21*a*. While the intermediate transfer belt 9 rotates once, the voltage (+2000V) which is equal to the primary transfer bias voltage is applied from the fur brush 21*a* to the interval of the intermediate transfer belt 9 to which the non-transfer bias voltage has been applied. The electric potential of this interval is set to (+2000V) as a second correction potential. The output of the voltage is turned off for the period of time during which the interval where the primary transfer bias voltage has been applied passes through the fur brush 21*a* upon image creation and the electric potential of this interval is set to 0V as a first correction potential, so that an impedance adjustment similar to that in the first embodiment can be realized.

The voltage (−200V) can be also applied instead of turning off the output of the voltage for the period of time during which the interval where the primary transfer bias voltage has been applied passes through the fur brush 21*a* upon image creation.

The voltage which is applied to the intermediate transfer belt 9 in order to correct the resistance value is output from the cleaning power source HV3 which is controlled by the power controller 301 and applied from the fur brush 21*a* to the intermediate transfer belt 9.

Although the above embodiments 1 to 5 have been described as an example with respect to the case where the charging characteristics of the toner indicate the negative polarity, the invention is not limited to such an example but can be also similarly applied to the case where the charging characteristics of the toner indicate the positive polarity. In such a case, it is sufficient that the polarity in the above description is inverted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-316370, filed Nov. 22, 2006, which is hereby incorporated by reference herein in its entirety.

What is claimed is:

1. An image forming apparatus comprising:

an image bearing member which can rotate;

a image forming unit which can form each color of toner image onto the image bearing member by means of different colors of toners having a negative polarity, the toner image to be formed on a recording material and a patch toner image for adjusting an image can be simultaneously formed on the image bearing member;

a patch detecting unit which detects the patch toner image formed on the image bearing member;

a controller which controls a toner image forming condition based on an output of the patch detecting unit;

an intermediate transfer belt which bears the toner image transferred from the image bearing member;

a transfer unit which forms a transfer portion transferring the toner image on the image bearing member onto the intermediate transfer belt;

a voltage controller which controls a voltage to be applied to the transfer unit so that a first voltage is applied to the transfer unit when the toner image on the image bearing member is transferred onto the intermediate transfer belt and a second voltage that is lower than the first voltage is applied to the transfer unit when the patch toner image on the image bearing member passes through the transfer portion; and an executing unit which executes an adjusting mode by applying a first adjusting voltage to a first area to which the first voltage has been applied and applying a second adjusting voltage that is higher than the first adjusting voltage to a second area to which the second voltage has been applied while the intermediate transfer belt rotates once, the toner image to be formed on the recording material can be formed on a position which overlaps both the first area and the second area by the adjusting mode.

2. An apparatus according to claim 1, wherein after a process in which the first voltage has been applied to the first area and the second voltage has been applied to the second area is repeated a plurality of times while the intermediate transfer belt rotates once, the executing unit executes the adjusting mode.

3. An image forming apparatus comprising:

an image bearing member which can rotate;

a image forming unit which can form each color of toner image onto the image bearing member by means of different colors of toners of a positive polarity, the toner image to be formed on a recording material and a patch toner image for adjusting an image can be simultaneously formed on the image bearing member;

a patch detecting unit which detects the patch toner image formed on the image bearing member;

a controller which controls a toner image forming condition based on an output of the patch detecting unit;

an intermediate transfer belt which bears the toner image transferred from the image bearing member;

a transfer unit which forms a transfer portion transferring the toner image on the image bearing member onto the intermediate transfer belt;

a voltage controller which controls a voltage to be applied to the transfer unit so that a first voltage is applied to the transfer unit when the toner image on the image bearing member is transferred onto the intermediate transfer belt and a second voltage that is higher than the first voltage is applied to the transfer unit when the patch toner image on the image bearing member passes through the transfer portion; and an executing unit which executes an adjusting mode by applying a first adjusting voltage to a first area to which the first voltage has been applied and applying a second adjusting voltage that is lower than the first adjusting voltage to a second area to which the second voltage has been applied while the intermediate transfer belt rotates once, the toner image to be formed on the recording material can be formed at a position which overlaps both the first area and the second area by the adjusting mode.

4. An apparatus according to claim 3, wherein after a process in which the first voltage has been applied to the first area and the second voltage has been applied to the second area is repeated a plurality of times while the intermediate transfer belt rotates once, the executing unit executes the adjusting mode.

5. An apparatus according to claim 1, wherein the first adjusting voltage has a polarity opposite to a polarity of the first voltage, and the second adjusting voltage has a polarity opposite to a polarity of the second voltage.

6. An apparatus according to claim 1, wherein the first adjusting voltage and the second voltage are the same voltage, and the second adjusting voltage and the first voltage are the same voltage.

7. An apparatus according to claim 3, wherein the first adjusting voltage has a polarity opposite to a polarity of the first voltage, and the second adjusting voltage has a polarity opposite to a polarity of the second voltage.

8. An apparatus according to claim 3, wherein the first adjusting voltage and the second voltage are the same voltage, and the second adjusting voltage and the first voltage are the same voltage.

* * * * *